US005485252A

United States Patent [19]

Ishida et al.

[11] Patent Number: 5,485,252

[45] Date of Patent: Jan. 16, 1996

[54] ELECTRIFYING DEVICE FOR AN IMAGE FORMING APPARATUS

[75] Inventors: Hiroshi Ishida; Masahiro Hashizume, both of Osaka, Japan

[73] Assignee: Mita Industrial Co., Ltd., Osaka, Japan

[21] Appl. No.: 316,360

[22] Filed: Oct. 24, 1994

[30] Foreign Application Priority Data

Nov. 8, 1993 [JP] - Japan ..... 5-278020

[51] Int. Cl.[6] ..... G03G 15/02

[52] U.S. Cl. ..... 355/219; 361/225

[58] Field of Search ..... 355/219, 221, 355/222, 227; 361/220, 222, 225, 230

[56] References Cited

U.S. PATENT DOCUMENTS

| | | | |
|---|---|---|---|
| 4,803,593 | 2/1989 | Matsumoto et al. | 361/225 |
| 5,293,200 | 3/1994 | Tsusaka | 355/219 |

FOREIGN PATENT DOCUMENTS

| | | | |
|---|---|---|---|
| 62-296174 | 12/1987 | Japan | 355/219 |
| 1-292358 | 11/1989 | Japan | 355/219 |
| 3-29972 | 2/1991 | Japan | 355/219 |
| 5-232780 | 9/1993 | Japan | 355/219 |
| 6-27782 | 2/1994 | Japan | 355/219 |

*Primary Examiner*—William J. Royer
*Attorney, Agent, or Firm*—Koda and Androlia

[57] ABSTRACT

The present invention relates to an image forming apparatus for a copying machine, a printer, etc., which is provided with an electrifying member disposed opposite to the surface of a photosensitive body and electrifying the surface thereof by applying electric charge thereto. An electrifying member disposed opposite to the surface of a photosensitive body and electrifying the surface thereof by application of electric charge has a curved or flat face along the surface of the photosensitive body and resistance from $10^5$ to $10^{10}$ ohms, and at the same time the electrifying member is disposed about 350 μm to about 1000 μm from the surface of the photosensitive body. The electrifying member may be curved to meet the curvature of the surface of the photosensitive body. A conductive portion to apply voltage to the electrifying member may be formed at the side of the electrifying member, which is opposite to the side facing the surface of the photosensitive body. Still furthermore, the electrifying member may be supported by the conductive portion formed at the electrifying member.

3 Claims, 3 Drawing Sheets

ELECTRIFYING DEVICE FOR AN IMAGE FORMING APPARATUS

BACKGROUND OF THE INVENTION

1. Field of the Invention

The present invention relates to an image forming apparatus for a copying machine, a printer, etc, which is provided with an electrifying member disposed opposite to the surface of a photosensitive body and electrifying the surface thereof by applying electric charge thereto.

2. Description of the Prior Art

For example, in an image forming apparatus of electronic photography system, an electrifier of corona discharge system has been generally employed. However, the corona discharge system generates a great deal of harmful products such as ozone, etc. Therefore, there is caused such a problem that may result in large sizing, an increase of production cost, etc., in order to make countermeasures against them. For this reason, an ozone-free electric charge application system which hardly has such problems has recently been taken into consideration.

FIG. 4 is a view showing the outline configuration of one of the examples of such a conventional image forming apparatus A.

As shown in FIG. 4, in the conventional image forming apparatus A, an electrifying roller 12 is brought into contact with a drum-like photosensitive body 2 with pressure, and is driven in line with revolutions of the photosensitive body 2. The electrifying roller 1*a* is a conductive member made of, for example, silicon and nylon, and has a fixed resistance ($10^5$ to $10^9$ ohms). Voltage is applied to the electrifying roller 1*a* through the rotation axis thereof from a power source 3.

A certain potential is applied to the photosensitive body 2 from the pressure-contacting surface of the electrifying roller 1*a* by application of the voltage. However, as no electric discharge is generated at this time, harmful products such as ozone, etc., are hardly generated. Namely, it is possible to achieve an ozone-free electric charge.

Next, light exposure 4 is applied to the uniformly electrified surface of the photosensitive body 2 by a light exposing means (not illustrated). An electrostatic latent image of the target image information is gradually formed on the circumferential surface of the photosensitive body 2 by this light exposure 4. And the latent image is developed by a developing roller 5 as a toner image. Next, the latent image is gradually transferred onto a sheet of paper, which is fed by a paper feeding mechanism (not illustrated), by a transferring roller 6. The sheet of paper is separated from the photosensitive body 2 after the latent image is transferred thereto and is fed to a fixing device (not illustrated), wherein the transferred toner image is fixed on the sheet of paper. The toner residues and foreign adhered substances on the photosensitive body 2, the latent image of which has been transferred, are removed by a cleaning member 7, thereby causing the photosensitive body 2 to be repeatedly used. Thus, a series of image formations are carried out.

With the conventional image forming apparatus A described above, as the electrifying roller 1*a* is pressure-contacted to the photosensitive body 2, there are several problems such as staining of the electrifying roller 1*a*, wearing thereof, staining of the photosensitive body 2 due to the roller. For this reason, it was considered (in Japanese patent publication No. Hei-3-2400765) that the electrifying roller 1*a* is disposed apart from the photosensitive body 2. According to the same patent publication, the clearance between the electrifying roller 1*a* and the photosensitive body 2 is disclosed to be 5 μm to 300 μm. And it is also said in the same patent publication that where the clearance is more than 350 μm, insulation breakdown resulting therefrom causes a leak discharge to be generated, and the apparatus A would not be able to be used. Actually however, it is very difficult to secure the dimensional control within 300 μm. For example, there is a possibility for the electrifying roller 1*a* to be brought into contact with the photosensitive body 2 due to a bending of the roller and the dimensional tolerance thereof. Furthermore, where the clearance is within 300 μm, residues and foreign substances on the photosensitive body 2 may be brought into contact with the roller, unless they are removed by a cleaning member 7.

SUMMARY OF THE INVENTION

The invention has been developed to solve such problems as exist in the prior arts. It is therefore an object of the invention to provide an image forming apparatus which generates remarkably little ozone and always has a good electrification performance which is not influenced by the conditions of the surface of a photosensitive body and electrifying member, etc.

An image forming apparatus according to the invention to achieve the above object is provided with an electrifying member disposed opposite to the surface of a photosensitive body and electrifying the surface thereof by application of electric charge, and is characterized in that the electrifying member has a curved or flat face along the surface of the photosensitive body and resistance from $10^5$ to $10^0$ ohms, and at the same time the electrifying member is disposed about 350 μm to about 1000 μm from the surface of the photosensitive body.

The electrifying member may be curved to meet the curvature of the surface of the photosensitive body.

Furthermore, it is possible to form a conductive portion to apply voltage to the electrifying member at the side thereof, which is opposite to the side facing the surface of the photosensitive body.

Still furthermore, it is possible to support the electrifying member by the conductive portion formed at the electrifying member.

According to the invention, an electrifying member is disposed opposite to the surface of a photosensitive body and electrifies the surface thereof by application of electric charge, and the electrifying member has a curved or flat face along the surface of the photosensitive body and resistance from $10^5$ to $10^{10}$ ohms, and at the same time the electrifying member is disposed about 350 μm to about 1000 μm from the surface of the photosensitive body.

Thereby, electric discharge hardly occurs due to insulation breakdown between the electrifying member and photosensitive body. Therefore, in a case where the clearance therebetween is made sufficiently large, it is possible to secure an ozone-free electric charge application, and it is also possible to achieve a good electrification performance, which is not influenced by the conditions of the surface of the electrifying member and photosensitive body, etc., at all times.

In a case where the electrifying member is curved to meet the curvature of the surface of the photosensitive body, uniformity of the electrification is much improved, and it is possible to secure a better electrification performance.

Furthermore, in a case where a conductive portion to apply voltage to the electrifying member is formed at the side of the electrifying member, which is opposite to the side facing the surface of the photosensitive body, and the electrifying member is supported by the conductive portion formed at the electrifying member, the voltage to supply electric charge to the electrifying member is efficiently applied, and the rigidity of the electrifying member is secured, thereby causing the above clearance to be securely kept. Therefore, a much better electrification performance is achieved.

The specification particularly points out the subjects of the invention and ends with the claims which clearly claim the disclosure of the invention. The invention is better understood with the following description with reference to the drawings attached herewith.

DETAILED DESCRIPTION OF THE PREFERRED EMBODIMENT

While only certain embodiments of the present invention have been described, it will be apparent to those skilled in the art that various changes and modifications may be made therein without departing from the spirit and scope of the invention.

Figure 1:
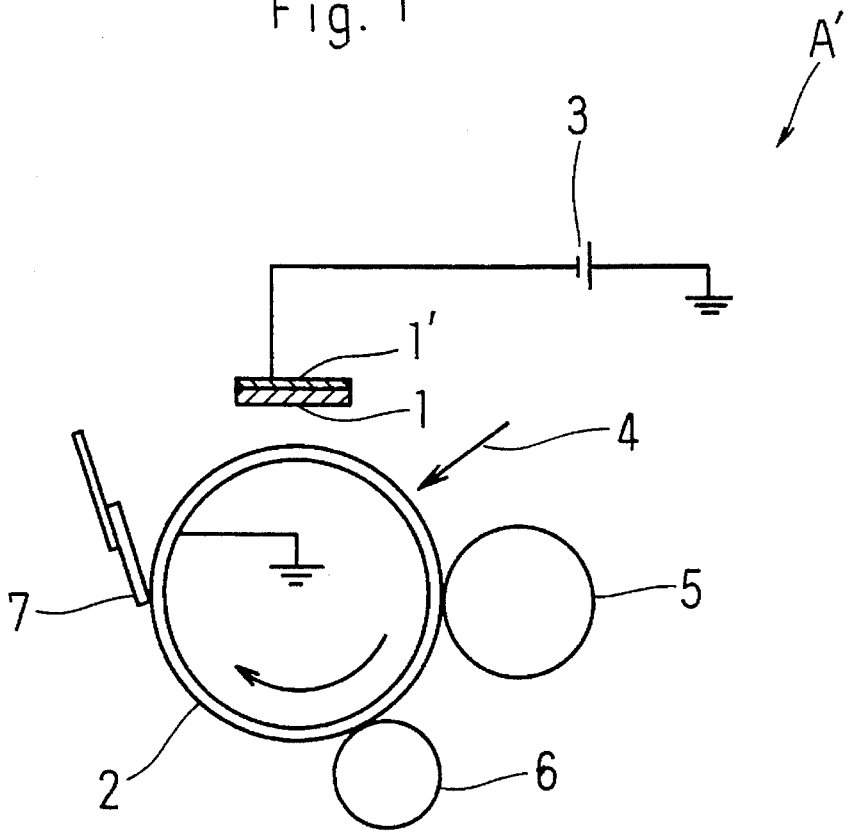
FIG. 1 is a view showing the outline configuration of an image forming apparatus A' according to a preferred embodiment of the invention.

As shown in FIG. 1, an image forming apparatus A' according to the preferred embodiment is similar to the conventional example in that it is provided with an electrifying member 1 which is disposed opposite to the surface of a photosensitive body 2 and electrifies the surface thereof by application of electric charge. But the image forming apparatus A' is different from the conventional example in that the electrifying member 1 has a curved or flat face along the surface of the photosensitive body and a resistance from $10^5$ to $10^{10}$ ohms, and at the same time the electrifying member 1 is disposed about 350 μm to about 1000 μfrom the surface of the photosensitive body 2.

Hereinafter, a description will be given of the principle, actions, etc., of the image forming apparatus A'.

The photosensitive body 2 is driven and rotated in the direction of the arrow in the drawing at a required peripheral speed. The electrifying member 1 disposed opposite to the photosensitive body 2 is made of such a material as foamed urethane, foamed silicon, urethane rubber, silicon rubber, etc. However, the electrifying member 1 has the resistance of about $10^5$ to $10^{10}$ ohms, taking the conductivity into consideration as an electrifying member. There is no specified limitation in the material of the electrifying member 1 as far as this resistance is satisfied. A stainless steel plate 1'(which corresponds to a conductive part) is provided and adhered to the rear side of the electrifying member 1, and a direct current is applied to the stainless steel plate 1' from a power source 3.

Figure 3:
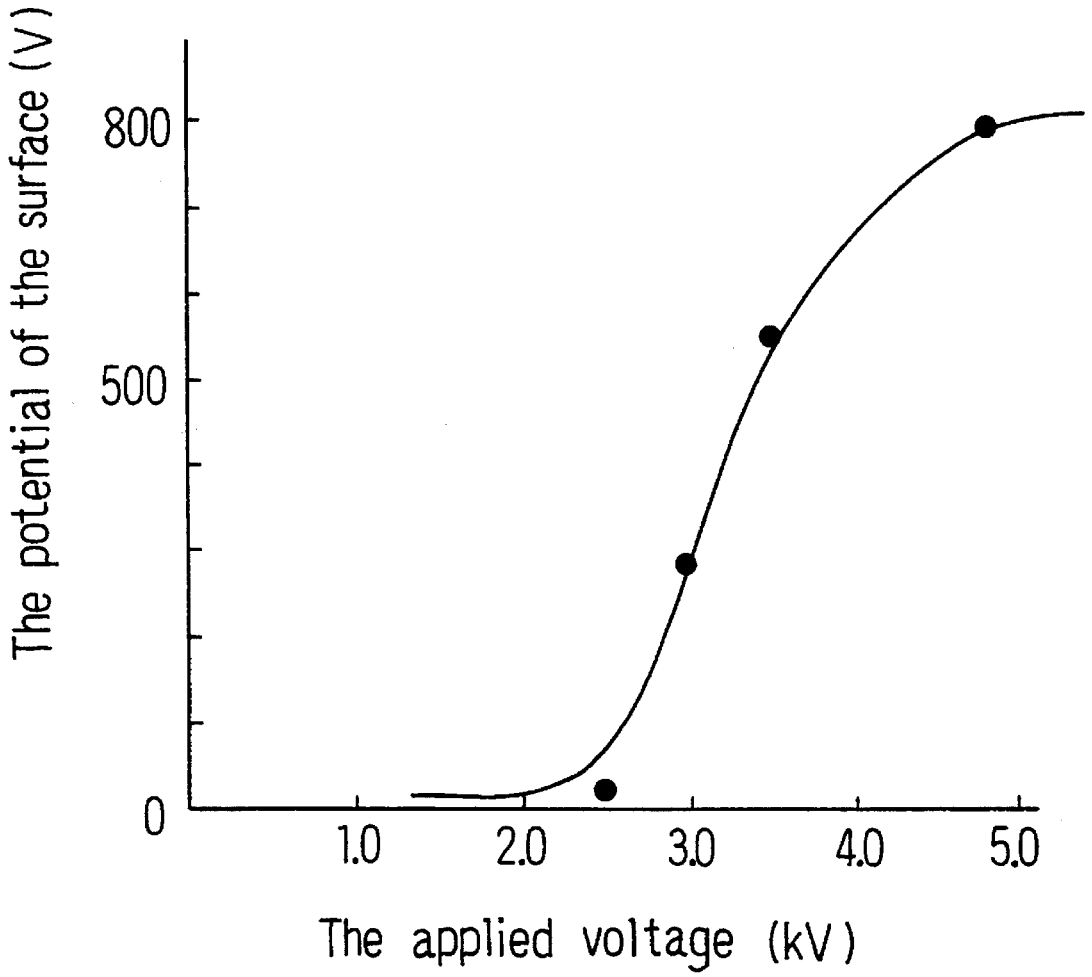
FIG. 3 is a diagram showing the correlation between the applied voltage and the potential of the surface.
Figure 4:
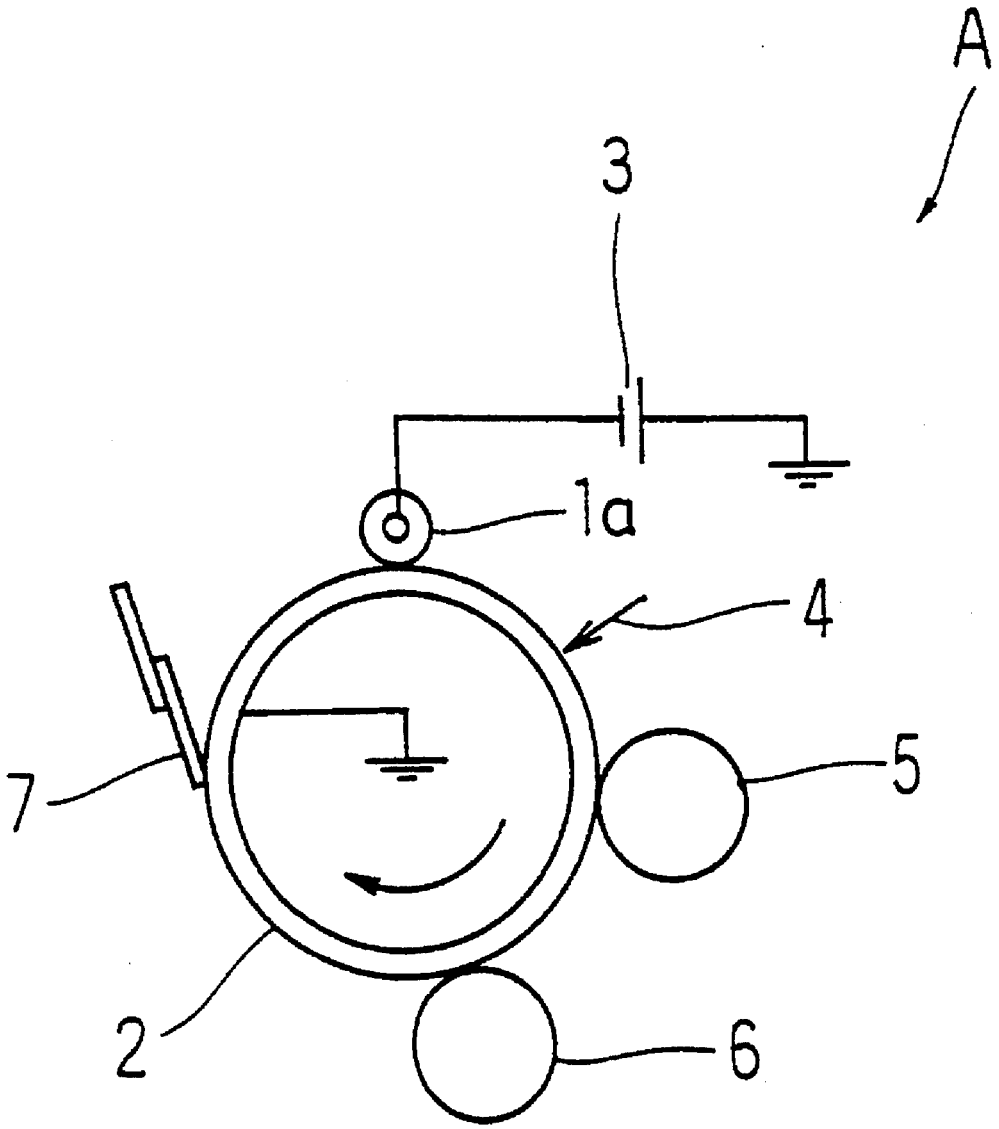
Fig. 4 PRIOR ART
FIG. 4 is a view showing the outline configuration of one of the examples of a conventional image forming apparatus A.

FIG. 3 shows a correlation between the applied voltage and the electrified voltage, which has been obtained through experiments where foamed urethane is used as the electrifying member 1 and the clearance between the electrifying member 1 and the photosensitive body 2 is 0.5 millimeters. As seen in FIG. 3, it is understood that the photosensitive body 2 is sufficiently electrified with a low voltage. At this time, the output current is 5 μA to 7 μA (according to the experimental data). Thereby it is predictable that ozone is remarkably less generated. Furthermore, when the clearance between the electrifying member 1 and the photosensitive body 2 was caused to alter from 350 μm to 1000 μm with a voltage of about 5 kV applied, the potential of the surface of the photosensitive body 2 was 700 V to 800 V. It is understood from the above viewpoint that it is possible to achieve an ozone-free electric charge with almost the above clearance, and to secure a desired electrification performance.

As described above, even though the clearance between the electrifying member 1 and the photosensitive body 2 is made large, the reason why any electric discharge does not occur due to insulation breakdown is considered as follows:

In the conventional example where the photosensitive body is apart from the electrifying member, the electrifying member, the radius of which is smaller than that of the photosensitive body, is used, the portion of the electrifying member at the photosensitive body side forms a so-called sharp-pointed part where an electric discharge is likely to occur. On the other hand, as an electrifying member having a curved or flat face along the surface of the photosensitive body is used in the present invention, such a sharp-pointed part is not constituted. Therefore, it is considered that an electric discharge hardly occurs.

The reason why a flat face may be acceptable is that there is no likeliness for the photosensitive body side to form any significant sharp-pointed part as the radius of the photosensitive body is comparatively large.

Furthermore, as no likeliness for the electrifying member 1 to be brought into contact with the photosensitive body 2 is secured by providing the above clearance, the electrification performance is not influenced by the conditions of the surface of the electrifying member 1 and photosensitive body 2. Still furthermore, the photosensitive body 2 is not stained due to the electrifying member 1.

The motions after the electrification are similar to those in the conventional example. Namely, light exposure 4 is carried out by a light exposure means (not illustrated) on the surface, to be uniformly electrified, of the photosensitive body. With this light exposure 4, an electrostatic latent image of the target image information is gradually formed on the circumferential surface of the photosensitive body 2, and is developed by the developing roller 5 as a toner image. Next, the latent image is gradually transferred onto a sheet of paper, which is fed by a paper feeding mechanism (not illustrated), by a transferring roller 6. The sheet of paper is separated from the photosensitive body 2 after the latent image is transferred thereto and is fed to a fixing device (not illustrated), wherein the transferred toner image is fixed on the sheet of paper. The toner residues and foreign adhered substances on the photosensitive body 2, after the latent image of which has been transferred, are removed by a cleaning member 7, thereby causing the photosensitive body 2 to be repeatedly used. Thus, a series of image formation are carried out.

Figure 2:
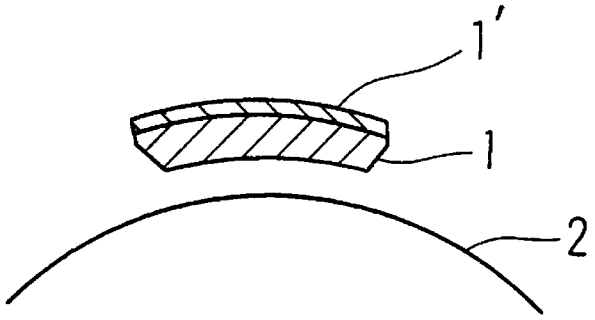
FIG. 2 is a view showing an example of the structures of another electrifying member applicable to the image forming apparatus A'.

Furthermore, in a case where the electrifying member 1 is curved to meet the curvature of the photosensitive body 2 as shown in FIG. 2, the uniformity of electrification is much improved, and the electrification performance will be made much better. However, it is necessary that both ends of the electrifying member 1 at the photosensitive body 2 side is, for example, rounded so that no sharp-pointed part where an electric discharge is likely to occur is formed.

From the above description, the following will be apparent.

(1) As electric discharge due to insulation breakdown between the electrifying member and the photosensitive body will hardly occur, it will be possible to supply an ozone-free electric charge even though the clearance therebetween is made sufficiently open, thereby causing a good electrification performance to be secured at all times without being influenced by the conditions of the surface of the electrifying member and photosensitive body.

(2) In a case where the electrifying member is curved to meet the curvature of the surface of the photosensitive body, as the uniformity of electrification is improved, it is possible to secure a much better electrification performance.

(3) Furthermore, in a case where a conductive part is installed at the rear side of the electrifying member and the electrifying member is supported by the conductive part, voltage to supply electric charge to the electrifying member is efficiently applied, and at the same time the rigidity of the electrifying member is secured. Therefore, as the above clearance is easily secured, a much better electrification performance is obtained.

As a result, it is possible to provide an image forming apparatus always having a good electrification performance without being influenced by the conditions, of the surface of the electrifying member and photosensitive body, etc.

Furthermore, with the above preferred embodiment, a stainless steel plate 1' is provided as a conductive part of the electrifying member. However, in an actual application, the electrifying member 1 may be concurrently used as a conductive part by causing the electrifying member 1 to have a sufficient rigidity, because there is no likeliness for the electrifying member 1 to damage the photosensitive body 2 as the apparatus A' is of a noncontact system.

Furthermore, in the above preferred embodiment, it is assumed that a drum-like member is used as the photosensitive body 2. However, there is no problem if a band-like member is used for the same purpose.

What is claimed is:

1. An electrifying device of an image forming apparatus having an electrifying member disposed opposite to the surface of a photosensitive body and electrifying the surface thereof by application of electric charge and curved to meet the curvature of the surface of the photosensitive body, and has a curved or flat face along the surface of the photosensitive body and resistance from $10^5$ to $10^{10}$ ohms, and at the same time the electrifying member is disposed about 350 μm to about 1000 μm from the surface of the photosensitive body, and being characterized in that both ends of the electrifying member at the photosensitive body arc rounded or cut so that no sharp-pointed pan where an electric discharge is likely to occur.

2. An electrifying device of an image forming apparatus set forth in claim 1, wherein a conductive portion to apply voltage to the electrifying member is formed at the side of the electrifying member, which is opposite to the side facing the surface of the photosensitive body.

3. An electrifying device of an image forming apparatus set forth in claim 2, wherein the electrifying member is supported by the conductive portion formed at the electrifying member.

* * * * *